United States Patent [19]

Kurokawa et al.

[11] Patent Number: 4,867,593

[45] Date of Patent: Sep. 19, 1989

[54] LIQUID DISPENSER WITH VALVE MECHANISM AND FLEXIBLE CONTAINER

[75] Inventors: Takumi Kurokawa, Koshigaya; Takeshi nagaki, Tokyo; Tomozo Sekiguchi, Kawaguchi, all of Japan

[73] Assignee: Pentel Kabushiki Kaisha, Tokyo, Japan

[21] Appl. No.: 146,682

[22] Filed: Jan. 21, 1988

[30] Foreign Application Priority Data

Jan. 30, 1987 [JP] Japan ..... 62-12348
May 15, 1987 [JP] Japan ..... 62-72587

[51] Int. Cl.[4] ..... A45D 34/00; A46B 11/00; A65D 37/00

[52] U.S. Cl. ..... 401/186; 222/212; 222/213; 401/184

[58] Field of Search ..... 401/186, 185, 184; 222/212, 213

[56] References Cited

U.S. PATENT DOCUMENTS 2,972,161 2/1961 Roehrich ..... 401/186
3,154,222 10/1964 Heckman ..... 222/213
3,241,727 3/1966 Heckman ..... 222/213
3,439,843 4/1969 Corsette ..... 222/212

FOREIGN PATENT DOCUMENTS 595557 8/1958 Italy ..... 222/213
55-32784 3/1975 Japan .
15893 7/1904 United Kingdom ..... 222/213

*Primary Examiner*—Steven A. Bratlie
*Attorney, Agent, or Firm*—Wenderoth, Lind & Ponack

[57] ABSTRACT

A liquid dispenser according to the present invention comprises a container having a rigid top portion and an elastic bag portion, an actuator having a cylindrical portion engageable with the top portion of the container, a pair of flexible legs each having a bent portion and a valve aperture, and a valve device having a valve stem extending longitudinally in the container. The valve stem is engaged with the flexible legs at their ends. A spring is mounted between the actuator and the valve device for biasing the valve device to a closed portion. When pressure is applied manually onto a predetermined portion of the container, the flexible legs are actuated to move the valve out of its closed position so that a liquid in the container is discharged through the opened valve aperture.

4 Claims, 2 Drawing Sheets

LIQUID DISPENSER WITH VALVE MECHANISM AND FLEXIBLE CONTAINER

BACKGROUND OF THE INVENTION

The present invention relates to a liquid dispenser for discharging various kinds of liquids and, more particularly, to a liquid dispenser having a flexible container and a valve mechanism which can be actuated manually by adding a presure onto the flexible container. The present invention provides an improved liquid dispenser which permits a stable discharge of the liquid out of the container.

The liquid dispenser according to the present invention is suitably used for, especially, cosmetics such as nail colors, foundation, creams and other cosmetic liquids, and various kinds of liquids such as writing ink, eraser liquid, pastes and paints suitable for stationery, and foodstuff liquids.

A liquid dispenser having a valve which can be actuated by a collapsible container is known as disclosed in Japanese Utility Model Publication No. 55-32784, published Aug. 5, 1980. The dispenser disclosed in the publication has a valve stem having an inclined surface and a pair of flexible actuators each having a tapered portion adapted to coact with the inclined surface of the valve so that when the actuator is pressed inwardly by pressing the flexible container, the valve is forcibly moved away from a valve-aperture within the container to discharge a liquid out of the flexible container through the valve-aperture and a nib.

In the known liquid dispenser as described above, however, the valve is moved away from its closed position by frictional coaction between the inclined surface of the valve stem and the tapered portion of the flexible actuators. Consequently, the coacted portions are worn out by friction, with the result that valve-opening timing is delayed relative to the manual actuation of the actuator, the manual actuation being the application of pressure on the flexible container. Thus, the necessary amount of deformation of the collapsible container for opening the valve increases gradually as the frictionally coacting members are worn. Consequently, a stable discharge of the liquid is not maintained.

SUMMARY OF THE INVENTION

An object of the present invention is to provide an improved liquid dispenser which can provide a stable discharge of a liquid with less deformation of a flexible container.

Another object of the present invention is to provide a liquid dispenser which permits smooth movement of a valve by the manual pressing of the flexible container.

A liquid dispenser according to the present invention comprises a container having a rigid top portion and an elastic bag portion, an actuator having a cylindrical portion engageable with the top portion of said container, a pair of flexible legs each having a bent portion and a valve aperture, and a valve device having a valve stem extending longitudinally in the container. The valve stem is engaged with the flexible legs at their ends. A spring is mounted between the actuator and the valve device for spring-biasing the valve device to a closed position. When pressure is applied manually onto a predetermined portion of the container, the flexible legs are actuated to move the valve out of its closed position so that a liquid in the container is discharged through the opened valve aperture.

In an embodiment of the invention, the flexible container has opposed deformable portions and opposed non-deformable portions, and the container is rotatably engaged with the holder body. The container is rotatable relative to the holder body at 90 degrees so that the flexible legs of the actuator device are positioned proximal to the opposed deformable portion of the container when the device is in use and the legs are positioned proximal to the opposed non-deformable (or unoperable) portions.

PREFERRED EMBODIMENTS OF THE INVENTION

Figure 1:
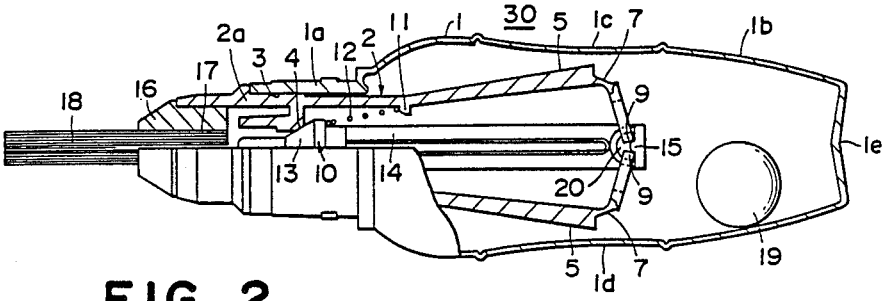
FIG. 1 is an elevation, partly sectioned, of a liquid dispenser embodying the present invention.
Figure 2:
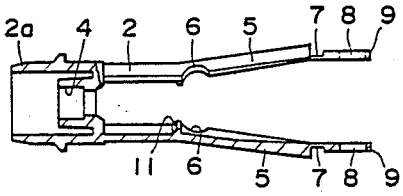
FIG. 2 is a partly sectioned side view of an actuator device shown in FIG. 1.
Figure 3:
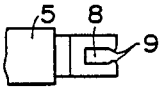
FIG. 3 is a fragmentary top plan view of a part of the actuator device shown in FIGS. 1 and 2.
Figure 4:
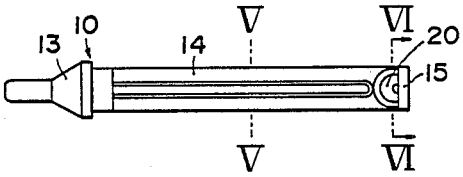
FIG. 4 is a side view of a valve device adopted to, and coactable with, the actuator device shown in FIGS. 1-3, FIGS. 5 and 6 are sectional views of the valve device taken along lines V—V and VI—VI, respectively, in FIG. 4.
Figures 5, 6:
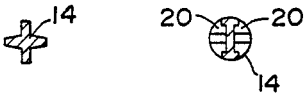

Referring to FIGS. 1 through 6 showing the first embodiment of the invention, a liquid dispenser which is generally represented by reference numeral 30 has a collapsible container 1 made of a flexible synthetic resin material such as nylon and polyacrylonitrile. The container 1 is readily deformable by fingertip pressure and restored when the pressure is released. The container 1 has a rigid top 1*a* and a flexible bag portion 1*b*. An actuator device 2 has a cylindrical portion 2*a* engaged by press-fitting with an opening 3 of the rigid top 1*a* and a pair of opposed flexible legs 5 extending into the flexible bag portion 1*b*. The legs 5 have thin portions 6 and 7 to provide flexibility and are connected at their extended ends to an end of a valve stem 14 which will be described presently. Each of the flexible legs 5 is bifurcated and has opposed projections 9 which are pivotably engaged with a semi-circular recess 20 of an engagement portion 15 of the valve stem 14.

The valve device 10 has a conical valve portion 13 having a tapered surface coactable with an aperture 4 of cylindrical portion 2*a* of the actuator device 2. The valve device 10 is spring-biased against the wall of the aperture 4 by a spiral spring 12 mounted between the conical valve portion 10 and projection 11 of the actuator so that the conical valve portion 13 hermetically closes the aperture 4 by the spring force of the spring 12. The valve stem 14 has an "X" shaped cross section to avoid deformation along the length thereof, the aforementioned semi-circular recess 20 is formed at the end distal to the conical valve portion 13. The valve portion 13 can be made in a spherical shape, if desired.

A cylindrical holder body 16 is engaged with a top end portion of the cylindrical portion 2*a* of the actuator 2 and also holds a nib 18 in an opening 17 of the holder 16. The nib 18 in the illustrated embodiment is a bundle of animal hair or fur but may be formed of a bundle of synthetic fibers, sponge, synthetic resin and any other suitable materials and forms.

The container 1 has a steel ball 19 for agitating the liquid in the container 1.

In the illustrated embodiment, the cylindrical portion 2*a*, legs 5 and the wall of aperture 4 are integrally formed but, if necessary, can be formed separately. Further, engagement between the flexible container 1 and the actuator device 2 can be achieved by a threaded rather than the press-fit engagement.

Figure 7:
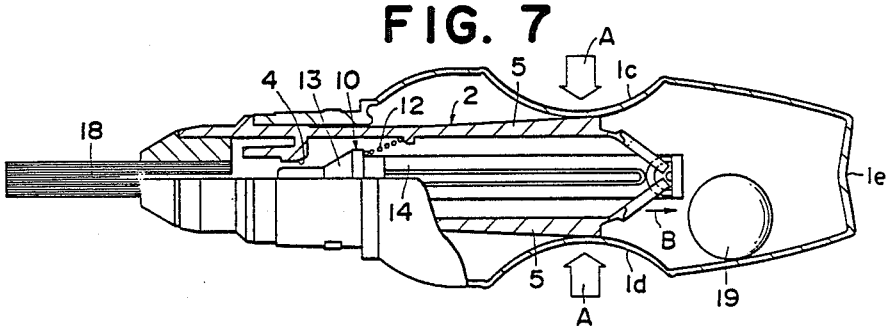
FIG. 7 is, as similar as FIG. 1, a partly sectioned elevation of the liquid dispenser, showing an operational mode of the dispenser.

An operation as well as the other structural features of the liquid dispenser 30 will be described with reference to FIGS. 1 and 7. In the state shown in FIG. 1, the valve device is hermetically engaged with the aperture wall 4 of the actuator body 2 by means of the spiral spring 12 and the legs 5 are bent inwardly at the thinned portions 7 as illustrated. When a pressure is manually, by fingertip actuation, applied to predetermined opposed operational portions 1*c* and 1*d* of the flexible bag portion 1*b* of the container 1 to cause the operational portions 1*c* and 1*d* depressed as illustrated by two arrows A, the legs 5 of the actuator 2 are inwardly pressed and extended or unbent and, consequently, the valve body 10 is pulled toward a bottom 1*e* of the container 1 as illustrated by an arrow B. Consequently, the spring-biased engagement between the conical valve portion 13 and the aperture wall 4 of the actuator 2 is released by the movement of the valve device 2 and, simultaneously, the liquid is discharged through the aperture 4 and the nib 18.

Figure 8:
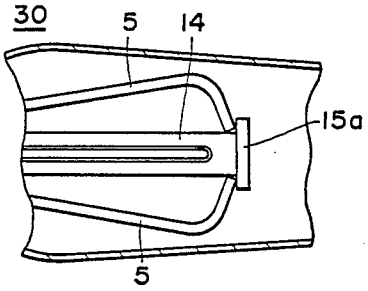
FIG. 8 is a fragmentary sectional view of a part of the liquid dispenser according to another embodiment of the invention.

In FIG. 8 showing the second embodiment of the invention, a liquid dispenser 30 is similar to that of the first embodiment of FIG. 1 except that the legs 5 of the actuator device 2 are resiliently bent and connected by a brim 15*a* without providing thinned portions (which are referred to by the reference numeral 7 in FIG. 1). This embodiment permits easy production of the actuator device 2 and the valve stem 14.

Figure 9:
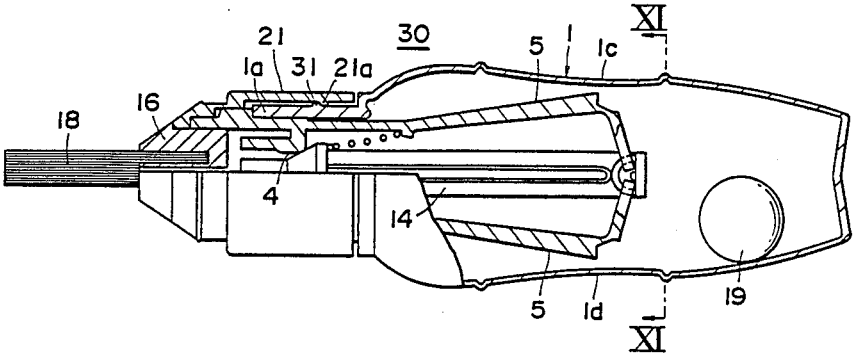
FIG. 9 is a partly sectioned elevation of a liquid dispenser according to a further embodiment of the invention.
Figure 11:
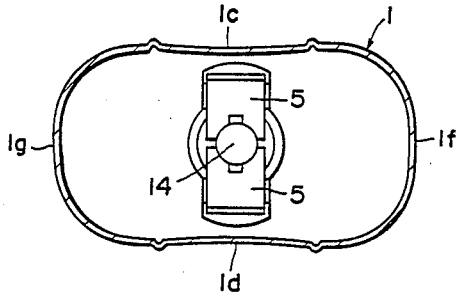
FIG. 11 is a sectional view taken along XI—XI in FIG. 9.

FIG. 9 shows another embodiment of the present invention. In this embodiment, a collar 21 having an annular projection 21*a* on the inner surface is fixed to the cylindrical portion 2*a* of the actuator 2 and the flexible container 1 is provided with a projection 31 on an outer surface of the rigid top portion 1*a* so that the container is rotatably engaged with the collar 20 by a detachable engagement between the two projections 21*a* and 31. When the collar 21 is rotated relative to the container 1, the actuator 2 is also rotated within the container 1. In the embodiment of FIG. 9, the container has an elliptical or lozenge-shaped or athletic-track-like cross-section having opposed longer sides (which are operable sides 1*c*, 1*d*) and opposed shorter sides (which are unoperable sides 1*f* and 1*g*) as illustrated in FIGS. 11 and 12.

Figure 10:
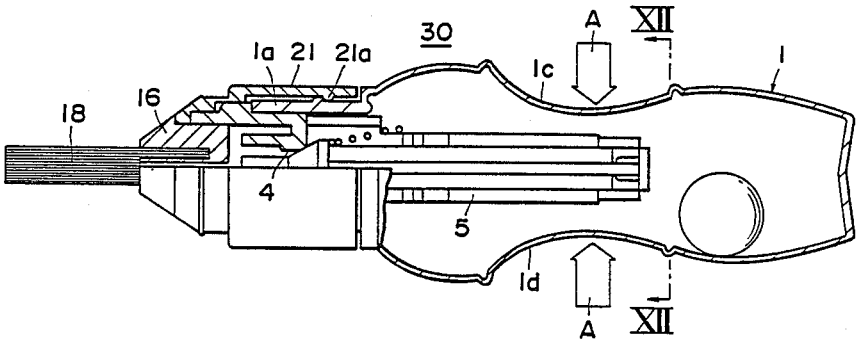
FIG. 10 is, as similar as FIG. 9, a partly sectioned elevation of the dispenser shown in FIG. 9, illustrating an operation.
Figure 12:
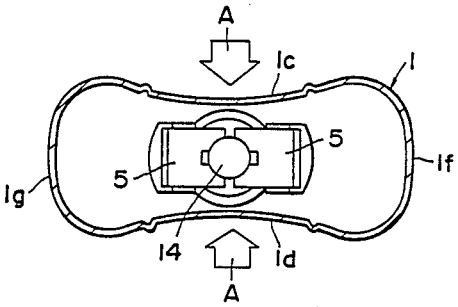
FIG. 12 is a sectional view taken along XII—XII in FIG. 10.

When the liquid dispenser 30 is not in use, the collar 21 is rotated at right angles relative to the container 1 so that the legs 5 of the actuator 2 are positioned in a spaced abutment relation to the unoperational or inoperable portions 1*f* and 1*g* as illustrated in FIGS. 10 and 12. In the position, even though operational portions 1*c* and 1*d* receive an unexpected pressure or force as illustrated by arrows "A" in FIG. 10, the legs 5 of the actuator 2 receives no force for actuation and, therefore, unexpected operation is prevented. In use, the collar 20 is rotated at right angles from the position of FIG. 10 relative to the container 1 so that the legs 5 of the actuator device 2 are positioned in a spaced abutment relation to the operational portions 1*c* and 1*d* of the container as illustrated in FIGS. 9 and 11, so that a force exerted on to the operational portions 1*c*, 1*d* can press the legs 5 of the actuator 2 to actuate or move the valve away from the aperture wall 4. Thus, a simple rotation of the collar to a predetermined position can prevent an unexpected discharging operation of the valve. In the embodiment of FIG. 9, a hermetic sealing is formed between the collar 20 and the rigid top portion 1*a* of the container 1 by the projections 21*a* and 31. The container 1 can be formed such that the operational portions are deformable by a fingertip pressure and the unoperational portions are rigid and undeformable.

According to the present invention, pressure exerted on to the operational portions of the container 1 can stretch the bent legs to an extended position to thereby reliably move the valve body, which has been engaged with the aperture wall, away from the aperture wall to open the aperture for discharging the liquid. Therefore, a simple manipulation can provide a reliable valve operation without any harmful friction between the elements and parts, and reliable discharge of the liquid can be obtained.

The foregoing description illustrates specific embodiments within the scope of the present invention that are not to be constructed as limiting the scope. It is to be understood that variations and modifications thereof may be made by those skilled in the art without departing from the scope of the invention.

What is claimed is:

1. A liquid dispenser comprising:

a container for containing a liquid and having a rigid top portion and a flexible elastic bag portion;

an actuator in said container and having a cylindrical portion engageable with said rigid top portion of said container, having a pair of inwardly movable flexible legs, each leg of said pair of flexible legs having a bent portion and a free end, and having a valve aperture in said actuator for fluidly communicating the inside and outside of said container;

a valve device in said container, attached to said rigid top portion of said container, and having a valve stem extending longitudinally in said container, said valve stem having first and second ends, said first end of said valve stem having means for blocking said valve aperture for blocking off fluid communication between the inside and outside of said container, said blocking means being entirely inside said container, said second end of said valve stem having means for movably engaging each free end of said pair of flexible legs, and said valve stem being movably engaged at its second end with said free ends of said pair of flexible legs;

each said actuator and said valve device being rotatable relative to said container, said container having spaced opposed operational portions coactable with said pair of flexible legs of said actuator, said container having inoperable spaced opposed portions, said actuator and said valve device being rotatable from a first position in which said pair of flexible legs is spaced opposed from said operational portions to a second position in which said pair of flexible legs is spaced opposed from said inoperable portions, and only said operational portions being able to contact said flexible legs when pressure is applied to the outside of said elastic bag portion and said actuator and said valve device are in the first position; and spring means in said container for biasing said valve device for moving said blocking means of said first end of said valve stem against said valve aperture for keeping said valve aperture normally closed, and when pressure is applied to the outside of said elastic bag portion of said container said bent portions of said flexible legs are pushed inwardly for moving said free ends of said flexible legs for moving said valve device against the resilient force of said spring means for causing said blocking means of said first end of said valve stem to move from said valve aperture for causing liquid to flow through said aperture to the outside of said container.

2. A liquid dispenser according to claim 1, wherein each leg of said pair of flexible legs includes a thin portion at the bent portion.

3. A liquid dispenser according to claim 1, wherein each leg of said pair of flexible legs has a projection at its free end, and said second end of said valve stem has a recess for receiving and movably retaining each said projection of said pair of flexible legs.

4. A liquid dispenser according to claim 1, wherein each leg of said pair of flexible legs has a resiliently bent portion and a connecting member for connecting said free ends of each of said pair of flexible legs with said second end of said valve stem.

* * * * *